US005717979A

United States Patent [19]

Senba et al.

[11] Patent Number: 5,717,979

[45] Date of Patent: Feb. 10, 1998

[54] IMAGE FORMING APPARATUS WITH AC CURRENT CONTROLLED CONTACT CHARGING

[75] Inventors: Hisaaki Senba, deceased, late of Yokohama, Japan, by Reiko Senba, legal representative; Mitsuka Abe, Yokohama; Keizo Takura, Kashiwa, both of Japan

[73] Assignee: Canon Kabushiki Kaisha, Tokyo, Japan

[21] Appl. No.: 720,909

[22] Filed: Oct. 3, 1996

[30] Foreign Application Priority Data

Oct. 4, 1995 [JP] Japan ..... 7-282489

[51] Int. Cl.[6] ..... G03G 15/02; G03G 15/00

[52] U.S. Cl. ..... 399/50; 399/174

[58] Field of Search ..... 399/50, 26, 128, 399/174, 175, 176; 361/225, 235

[56] References Cited

U.S. PATENT DOCUMENTS 5,144,368 9/1992 Ohzeki et al. ..... 399/176
5,305,177 4/1994 Aoki et al. ..... 361/225
5,420,671 5/1995 Kisu et al. ..... 399/174
5,485,248 1/1996 Yano et al. ..... 399/73
5,508,788 4/1996 Watanabe et al. ..... 399/175

FOREIGN PATENT DOCUMENTS 63-149668 6/1988 Japan .
8-62931 3/1996 Japan .
8-123152 5/1996 Japan .

*Primary Examiner*—Joan H. Pendergrass
*Attorney, Agent, or Firm*—Fitzpatrick, Cella, Harper & Scinto

[57] ABSTRACT

An image forming apparatus includes an image bearing member; a charging member contactable the image bearing member to charge the image bearing member at a charging position; wherein an AC current applied to the charging member is constant-current-controlled when a region of the image bearing member which is going to be an image formation region is at the charging position, and wherein a current flowing through the charging member is detected when a region of the image bearing member which is going to be a non-image-formation region is at the charging position, and the AC current is determined on the basis of the detected current.

5 Claims, 9 Drawing Sheets

IMAGE FORMING APPARATUS WITH AC CURRENT CONTROLLED CONTACT CHARGING

FIELD OF THE INVENTION AND RELATED ART

The present invention relates to an image forming apparatus such as an electrophotographic apparatus (copying machine, printer or the like) or an electrostatic recording apparatus, and more particularly to an image forming apparatus having a charging member contactable an image bearing member to charge the image bearing member.

Heretofore, as for a means for charging a surface of the image bearing member as a member to be charged such as a photosensitive member or dielectric member in image forming apparatuses, a corona discharging device are widely used. In this case, a discharge opening of the corona discharging device is faced, without contact, to the member to be charged, and the surface of the member to be charged is exposed to the corona current from the discharge opening to charge the member to be charged to a predetermined polarity and potential. It, however, involves drawbacks that it requires a high voltage generating source and that an ozone is produced.

A so-called contact type charging device wherein a charging member supplied with a voltage is contacted to charge the surface of the member to be charged, is advantageous in that the voltage of the voltage source can be reduced, and in that the production of ozone is small. This type has been noted and put into practice.

The contact type charging device includes a "DC charging system" wherein only a DC voltage $V_{DC}$ is applied as the charging bias to the charging member, and a "AC charging system" wherein an AC (AC voltage $V_{AC}$) biased DC voltage (DC voltage $V_{DC}$) is applied to the charging member.

In either type, the surface of the member to be charged is charged to a predetermined polarity and potential by the contact charging member supplied with such a bias voltage.

In an example of the AC charging system disclosed in Japanese Laid Open Patent Application No. SHO-63-149668 under the name of the assignee of this application, the charging member has a contact region in contact with the member to be charged, and a spaced surface region where the distance from the surface of the member to be charged increases downstream of the contact region with respect to the movement direction of the member to be charged. The charging member is supplied with a DC voltage component and an AC component having a peak-to-peak voltage which is higher than twice as high as a charge starting voltage which is a voltage level at which the charging of the member to be charged starts when a DC voltage is applied to the charging member. By this, an oscillating electric field is formed across the gap between the charging member and the surface of the member to be charged in the remote surface region. The AC component is effective to uniform the charge unevenness, and the DC component is effective to convert the potential to the predetermined potential, and therefore, the uniform charging is accomplished with stability. Accordingly, this type is now used relatively widely.

In the image forming apparatus, the photosensitive member as the image bearing member is gradually scraped at its outer peripheral surface by a cleaning blade, developer and the like with increase of the member of image formations, with the result that the thickness of the photosensitive layer (film thickness of the photosensitive member) decreases.

Therefore, the equivalent capacity thereof changes, and the charging property thereof changes.

In an AC charging system wherein a DC voltage is added to an AC voltage, the AC component is generally controlled such that the voltage or current is constant, and the DC voltage is generally controlled such that the voltage is constant. With this control, the uniformity of the charging is easily provided, but the surface potential gradually changes in accordance with decrease of the film thickness of the photosensitive member.

Then, the surface potential contrast between the black original and the white original decreases. In this case, in order to provide a sufficient development contrast in the development operation, no sufficient opposite contrast relative to the potential of a white image, cannot be provided, with the result of fog in the resultant image.

With the constant voltage or constant current control, excessive discharge may occur due to the change of the charging property resulting from the change of the film thickness of the photosensitive member, or the AC discharge may be insufficient due to it, so that the uniforming effect is weakened with the result of non-uniform charging.

Furthermore, it is known that there is a strong interrelation between the current flowing to the photosensitive member and the scraped Mount of the photosensitive member, more particularly, the scraped amount increases with increase of the current. In a system wherein the charging member is supplied with an AC biased DC voltage, as large as several hundreds μA to several mA of current flows, and therefore, the scraped amount is generally very large. With increase of the number of image formations, the film thickness of the photosensitive member rapidly decreases, with the result that the potential change is too large, or the potential is not uniform.

When the film thickness of the photosensitive member decreases, the current may tend to leak from the charging member to the photosensitive member substrate, even to an extent that the photosensitive layer per se becomes absent. If this occurs, the image formation is no longer possible.

SUMMARY OF THE INVENTION

Accordingly, it is a principal object of the present invention to provide an apparatus and method wherein the scraped amount of the image bearing member is decreased in an image forming apparatus using a contact type charging device as a charging means for an image bearing member.

It is another object of the present invention to provide an apparatus and method wherein the surface potential is stably uniform for a long term irrespective of the ambience variation film thickness change of the image bearing member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

<Embodiment 1> (FIG. 1–FIG. 8)

(Example of image forming apparatus)

Figure 1:
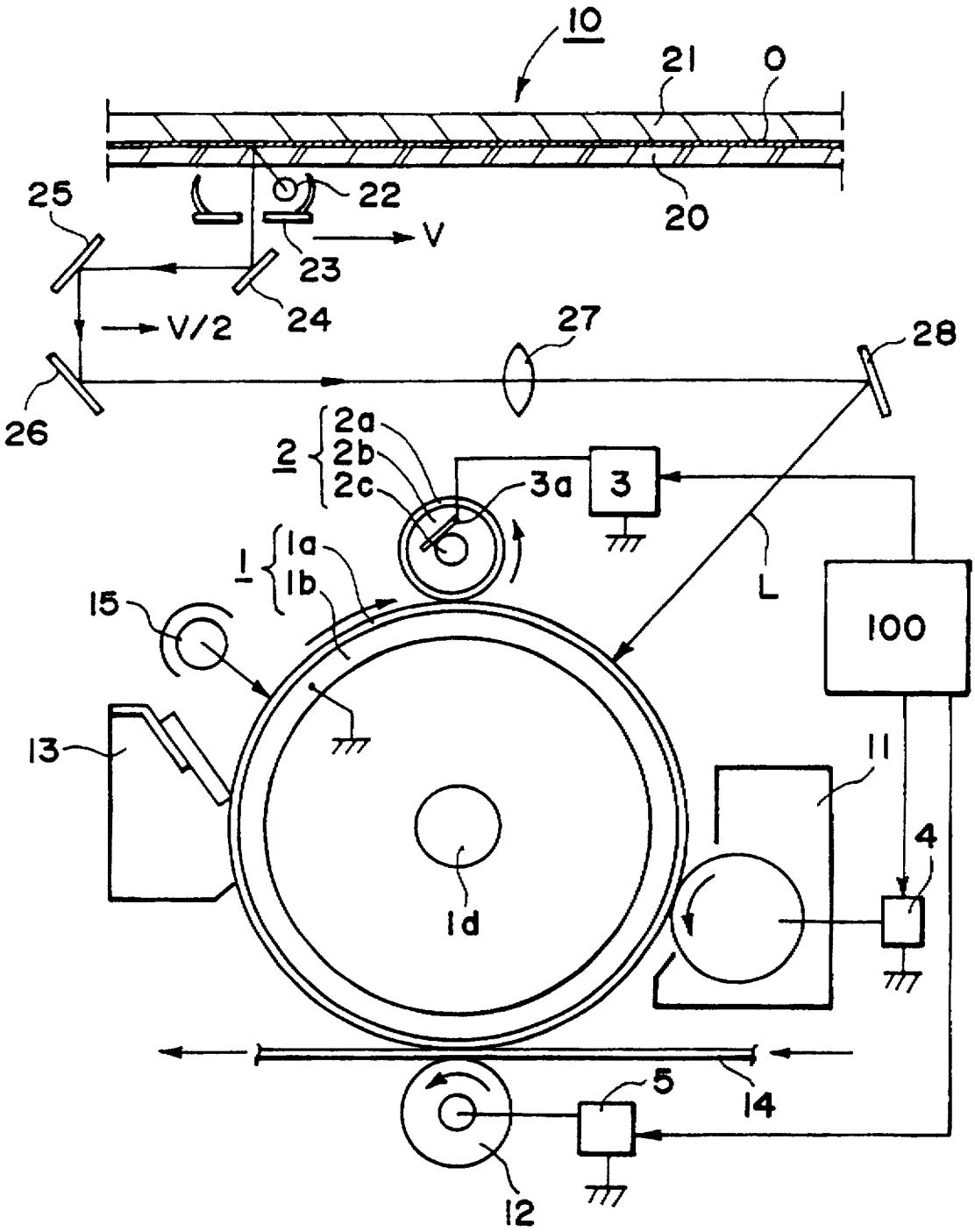
FIG. 1 is a schematic illustration of an example of an image forming apparatus.

FIG. 1 shows a schematic structure of an example of an image forming apparatus according to the present invention.

Designated by 1 is an image bearing member as a member to be charged. In this example, it is an electrophotographic photosensitive member in the form of a drum having an electroconductive base layer 1*b* of aluminum or the like, a photoconductive layer (photosensitive layer) 1*a* on the outer periphery thereof, as basic layers. It is rotated at a predetermined peripheral speed (process speed) in the clockwise direction in the drawing about a supporting shaft 1*d*.

Designated by 2 is a contact charging member for primary charging of the surface of the photosensitive member to a predetermined polarity and to a predetermined uniform potential. It is contacted to the surface of the photosensitive member 1. In this example, it is a roller type (charging roller).

The charging roller 2 comprises a central core metal 2*c*, an electroconductive layer 2*b* formed on the outer periphery thereof, and a resistance layer 2*a* on the outer periphery thereof. Opposite ends of the core metal 2*c* are rotatably supported by unshown bearing members so that it extends parallel to the drum type photosensitive member 1. It is press-contacted to the surface of the photosensitive member 1 with a predetermined urging force by unshown urging means.

A predetermined charging bias is applied to the core metal 2*c* through a sliding contact 3*a* from a charging bias voltage source 3, by which the peripheral surface of the rotatable photosensitive member 1 is charged (primary charging) to the predetermined polarity and the potential.

In this example, the voltage applied to the charging roller 2 from the charging bias voltage source 3, is an AC biased DC voltage ($V_{DC}+V_{AC}$) (AC charging system).

The photosensitive member 1 surface uniformly charged by the charging member 2, is then exposed to image information L by means of exposure means 10 (imaging slit exposure of an original image, laser beam scanning exposure or the like), by which a corresponding electrostatic latent image is formed on the peripheral surface thereof.

The exposure means 10 in the device of this example is an original image imaging slit exposure means for a known fixed original platen and movable optical system type. In the exposure means 10, designated by 20 is a fixed original supporting platen glass; O is an original placed and set on the platen glass with the image surface facing down; 21 is an original pressing plate; 22 is an original illumination lamp (image exposure lamp); 23 is a slit plate; 24–26 are movable first, second and third mirror; 27 is an imaging lens; and 28 is a fixed mirror. The lamp 22, slit plate 23 and first movable mirror 24 are moved at a predetermined speed V from one end side to the other end side of the original carriage glass 20 below the platen glass, and the second and third movable mirrors 25, 26 are moved at the speed of V/2, so that the bottom surface of the original is scanned from one end side to the other side, and the original image is projected and focused on the surface of the rotating photosensitive member 1 through the slit.

The formed latent image on the surface of the photosensitive member 1 is visualized into a toner image by developing means 11.

The developing means 11 uses an AC electric field. Designated by 11*a* is a rotatable developing roller or sleeve as a developer (toner) carrying member, and 4 is a developing bias voltage source for the developer carrying member 11*a*. The developer carrying member 11*a* is opposed to the photosensitive member 1, and it is supplied with a developing bias including at least an AC component from the developing bias voltage source 4, and the electrostatic latent image formed on the surface of the photosensitive member 1 is visualized into a toner image by deposition of the developer (toner) thereto.

The toner image is then transferred by transferring means 12 onto a transfer material 14 as a recording material which is fed to a transfer portion formed between the photosensitive member 1 and the transferring means 12 at proper timing in synchronism with rotation of the photosensitive member 1 from an unshown sheet feeding means portion.

The transferring means 12 of this example is a transfer roller, and a transfer bias is applied thereto from the transfer bias voltage source 5, so that the back side of the transfer material 14 is charged to the opposite polarity from the toner, by which the toner image is transferred from the surface of the photosensitive member 1 onto the surface of the transfer material 14.

The transfer material 14 having received the transferred toner image, is separated from the surface of the photosensitive member 1, and is fed to an unshown image fixing means, where the image is fixed, and then the transfer material 14 is discharged as a print. In the type wherein image formation is effected also on the back side, the transfer material is fed to refeeding means for refeeding it to the transfer portion.

After the image transfer, the surface of the photosensitive member 1 is cleaned by cleaning means 13 so that the residual toner and other deposited contamination are removed therefrom, and is discharged by discharging exposure device 15, so as to be prepared for repeated image forming operation.

Designated by 100 is a main control circuit portion for predetermined image formation operational sequence control of the image forming apparatus. The charging bias voltage source 3, developing bias voltage source 4, transfer bias voltage source 5 and the like are controlled by this main control circuit portion 100.

(Examples of the charging member 2)

The charging member 2 has an electroconductive charging member having a high resistance layer as a surface layer at least, for the purpose of prevention of leakage due to a pin hole or damage of the surface of the member to be charged.

The charging roller 2 as the contact charging member of the foregoing example, may be rotated by the photosensitive member 1 as the member to be charged, or may be unrotatable, or it may be positively rotated at a predetermined peripheral speed in the direction codirectionally or counterdirectionally relative to the surface movement direction of the photosensitive member 1. The layer structure of the roller 2 is not limited to the 3 layer structure 2c, 2b, 2a.

The contact charging member 2 may be in the form of a blade, block, rod or belt, as well as the roller type.

Figure 2A:
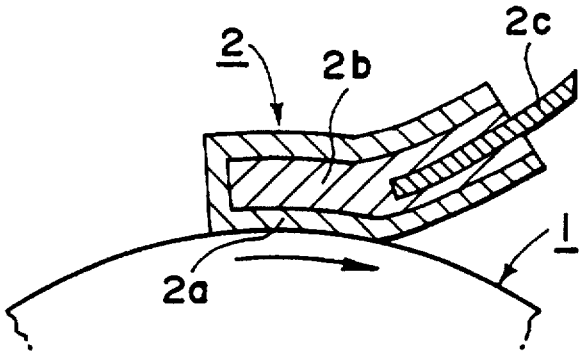
FIG. 2, (a) shows a schematic cross-section of an example of a contact charging member in the form of a blade, and (b) shows a schematic cross-section of an example of a contact charging member in the form of a block or rod.
Figure 2B:
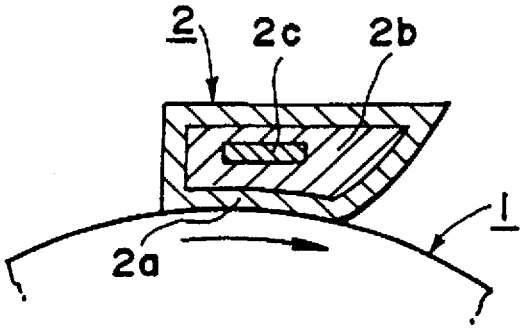

FIG. 2, (a) shows a cross-section of an example of a blade type member. In this case, direction of the charging member 2 in the form of a blade contacted to the surface of the photosensitive member 1, may be codirectional or counterdirectional with respect to the surface movement direction of the surface of the photosensitive member 1.

FIG. 2, (b) shows a cross-section of an example of a block or rod type.

In the charging member 2 of each type, designated by 2c is an electroconductive core metal member; 2b is an electroconductive layer; 2a is resistance layer.

In the cases of block or rod types, a lead line from the voltage source 3 can be directly connected to the core metal member 2c without the necessity of the power supply sliding contact 32a which is necessary to apply the bias voltage to the core metal member 2c in the case of the rotatable roller type. Therefore, the electrical noise which may arise from the power supply sliding contact 3a can be avoided, and additionally, it is advantageous in the space saving and in that it can be simultaneously used as a cleaning blade.

(Sequence)

Figure 3:
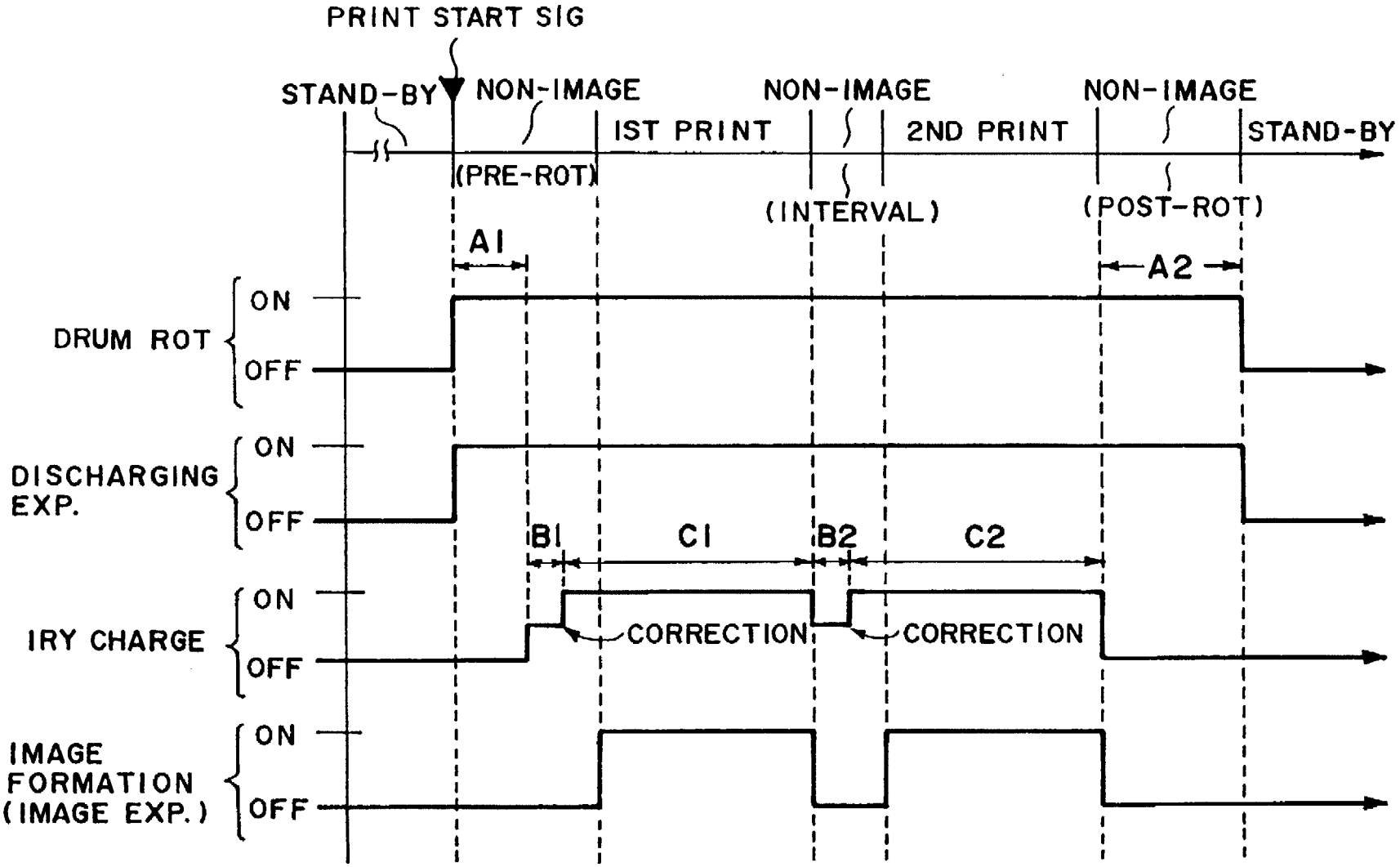
FIG. 3 is an operation sequence diagram.

FIG. 3 is an example of operational sequence of the device of FIG. 1. In this example, two sheet continuous print is taken.

(1) On the basis of a print (copy) start signal, the photosensitive member 1 (drum) in the stand-by state, is rotated (pre-rotation period). Simultaneously with the rotation start of the drum 1, the discharging exposure 15 ia actuated, and the drum 1 is electrically discharged not less than one full turn in the section A1.

(2) Subsequently, the bias voltage in the form of an AC voltage biased with a DC voltage (primary charging bias) is supplied to the charging roller 2 as the contact charging member.

(3) The primary charging bias is constant-voltage-controlled during the section B1 at first, during which the DC current component through the charging roller 2 is detected, and then the charging roller is supplied with the bias with the charging condition corresponding to the detected DC current component.

The pre-rotation is the rotation before the starting of the image formation, and the surface of the drum 1 during this period is a non-image-formation region surface. Therefore, the detection of the DC current component is carried out during the section B1 (pre-rotation) in which the charging position is faced the area corresponding to the non-image formation region of the drum 1. During this, the DC current is detected, and the primary charging condition correction is carried out (primary charging bias correction for the charging roller 2).

(4) After start of the voltage control for the charging roller with the primary correction condition, the voltage control is carried out (imaging slit exposure of the original image) for the first image formation.

The charging roller 2 charges such an area of the drum 1 as is going to be an image formation region with the corrected charging condition.

(5) After the completion of the image formation for the first print, the image formation is carried out for the second print. In the prior therebetween (sheet interval), the DC current detection and the charging condition correction are carried out again during this interval, and the second printing operation is carried out with the charging condition corrected on the basis of the detection.

When three or more continuous printing operations are to be carried out, the current detection and control for the charging roller 2 is carried out during each of the sheet intervals.

(6) After the completion of image formation of the last print, post-rotation is carried out (post-rotation period). The photosensitive member 1 is subjected to discharging exposure 15 not less than one full turn in section A2. Then the rotation and discharging exposure of the drum 1 are stopped, and the device is placed under the stand-by state until the next input of the print start signal.

(Charging condition correction system)

The correction of the charging condition (3) will be described in detail.

The charging mechanism using the charging roller 2 as the contact charging member is disclosed in Journal of DENSHI SHASHIN GAKKAI Vol. 30, No. 3, Pages 38–53. Major parts will be recited below.

(1) When DC voltage only is applied $$V_{DC}=V_R+V_{TH} \quad (1)$$

$V_{DC}$: applied voltage to the charging roller $V_{TH}$: start voltage of the discharge (a voltage level at which charging of the member to be charged starts when only DC voltage is applied to the charging member)

$V_R$: photosensitive member surface potential $$V_{TH}=\{(7737.6\times D)^{1/2}+312+6.2\times D\} \quad (2)$$

$$D=L_S/K_S \quad (3)$$

$L_S$: film thickness of the photosensitive member $K_S$: dielectric constant of the photosensitive layer $K_S$ change slightly depending on the temperature/humidity around the photosensitive member, but depending significantly on $L_S$ which changes with long term use.

Therefore, under the actual operation, if $V_{DC}$ is constant, the change of the photosensitive layer thickness ($L_S$) results in change of D, change of $V_{TH}$, change of $V_R$ (for example, when $L_S$ decreases, $V_{TH}$ decreases, and therefore, $V_R$ increases).

If $V_{DC}$ is constant, the current flowing from the charging roller to the photosensitive member increases when the $L_S$ is decreased in long term use, since the capacity of the photosensitive member is $D_P$ is proportional to $1/L_S$.

Thus, after long term use of the device, the current flowing from the charging roller to the photosensitive member increases with decrease of the film thickness of the photosensitive member.

Figure 4A:
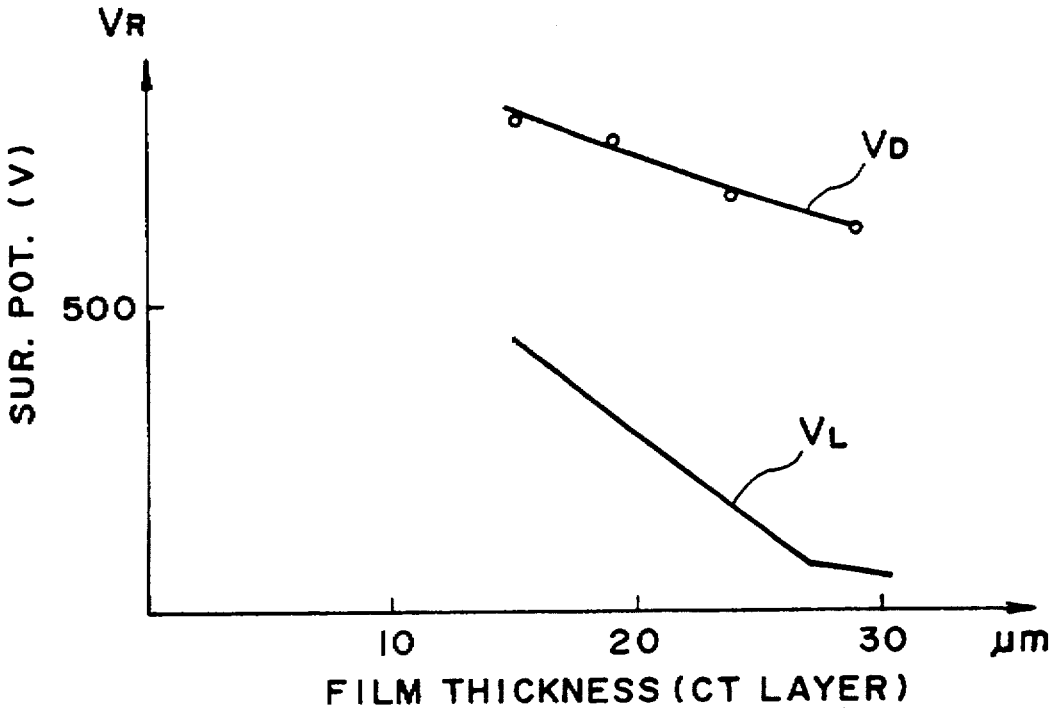
FIG. 4 is a graph showing a relation between a film thickness of a photosensitive member and a surface potential and DC current.
Figure 4B:
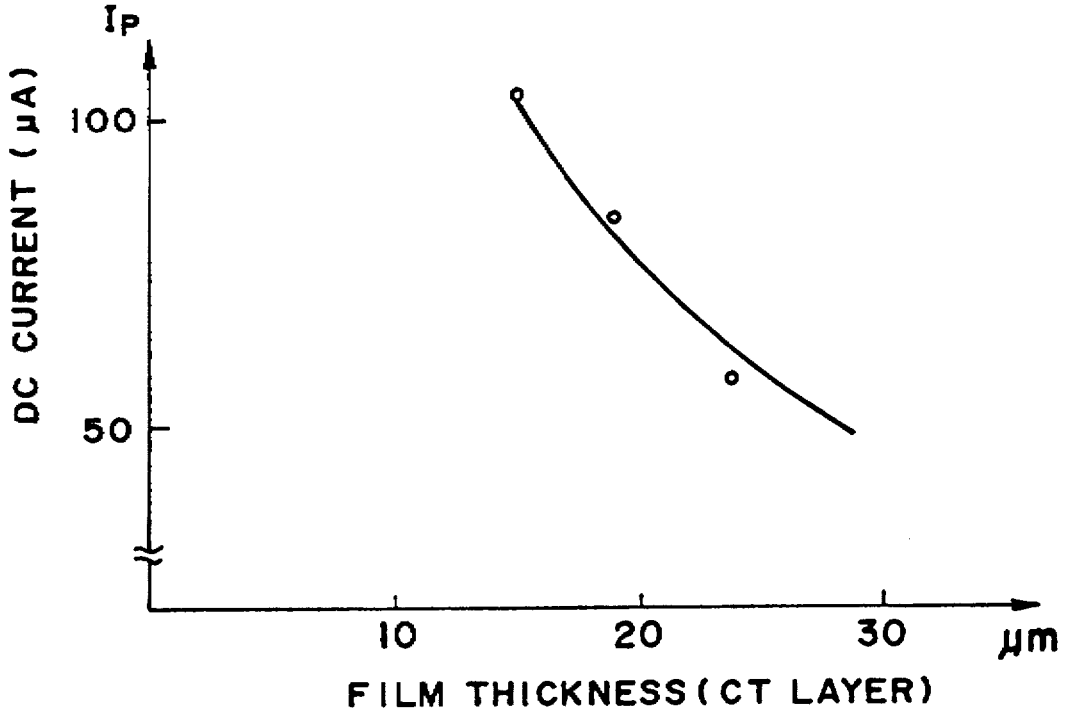

FIG. 4, (a) and (b) explains this interrelation with the abscissa representing the film thickness (CT film thickness) of the photosensitive member and the ordinate representing $V_R$, $I_P$ (the current from the charging roller to the photosensitive member). In this FIG., $V_D$ is a dark portion potential, and $V_L$ is a light portion potential. The voltage applied to the charging roller is a DC voltage without AC voltage, and is constant at 1420 V, and the voltage applied to the lamp 22 for the image exposure is constant.

Thus, if the charging is effected using only a DC voltage, the photosensitive member surface potential is not easily controlled in prior art.

(AC voltage biased DC voltage)

In this case, the electric field between the charging roller and the photosensitive member, changes with time by the AC application, so that a charging phase in which the electric discharge occurs from the charging roller to the photosensitive member, and a reverse charging phase in which the electric discharge of the opposite polarity occurs from the charging roller to the photosensitive member, are repeated.

To repeat these phases, the peak-to-peak voltage $V_{PP}$ of the AC voltage is not less than twice $V_{TH}$. When the $V_{PP}$ is sufficiently high, the local charging non-uniformity on the photosensitive member is removed by the AC electric field, so that the surface potential converges to a level close to the DC voltage value applied.

Figure 5:
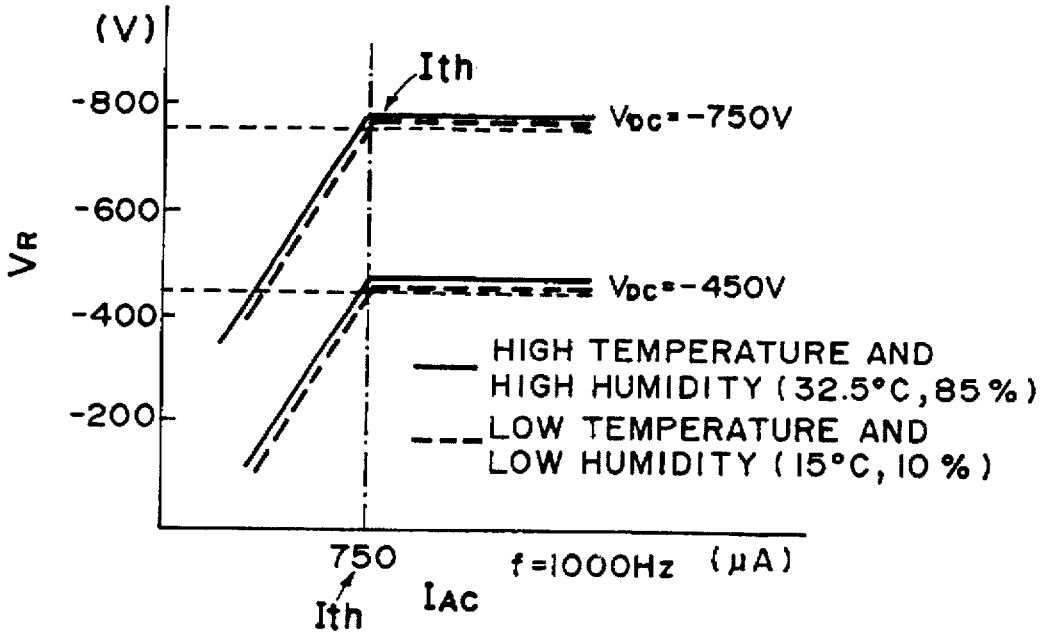
FIG. 5 is a graph showing a relation between an AC current and a charged potential.

With this charging system, the current is generally very large, since the discharge which is the same as with the DC voltage application as described in Paragraph (1), is repeated proportionally to the AC frequency. The discharge by the AC component is significantly influenced by a resistance change of the charging roller or the ambience. FIG. 5 shows a relation between the AC current and the photosensitive member surface potential. As will be understood, when the current is higher than a certain level Ith, the surface potential converges to a level close to the DC voltage independently of the ambience.

Figure 6:
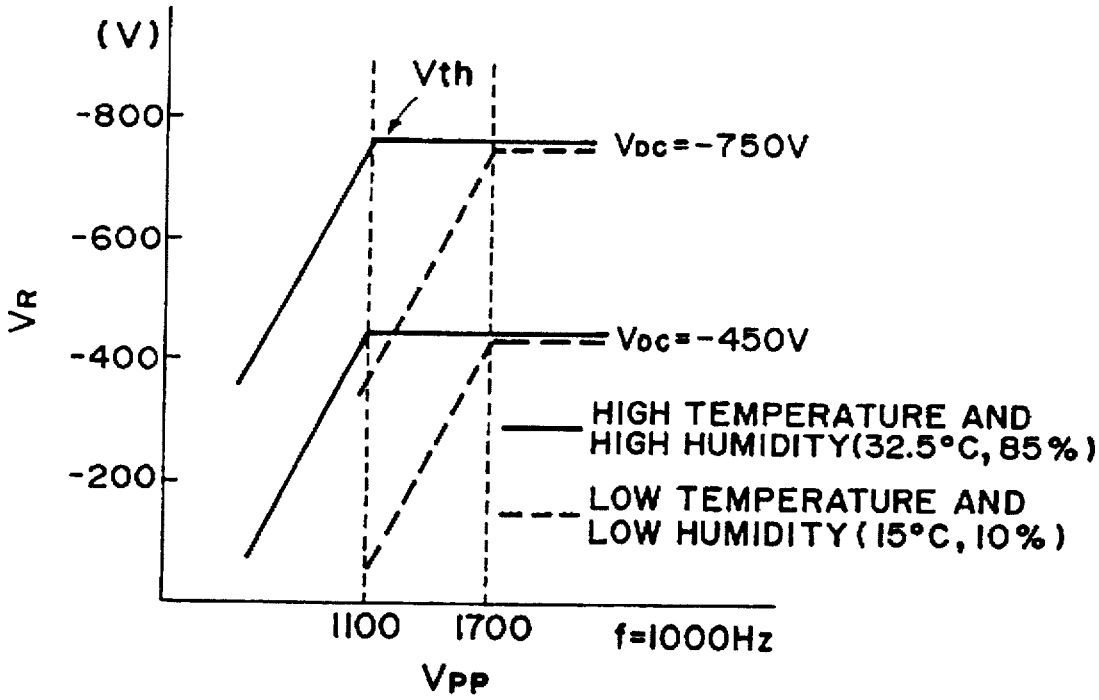
FIG. 6 is a graph showing a relation between a peak-to-peak voltage of an AC voltage and a charged potential under different ambiences.

However, as regards the relation between the AC voltage and the surface potential, as shown in FIG. 6, the surface potential changes depending on the ambience even if the voltage ($V_{PP}$) is constant.

For this reason, in the case that the charging member is supplied with an AC biased DC voltage, it is preferable that the AC component is controlled with constant current, and the DC component is controlled with constant voltage.

In FIGS. 5, 6, it is understood that the turning point represents switching from a charging state (DC charging) which is the same as with the case of application of substantially DC voltage alone without reverse charging, to a charging state (AC charging) which includes repetition of charging and reverse charging. When the film thickness of the photosensitive member changes, the capacity thereof changes, and therefore, the current flowing to the photosensitive member also changes. The change is the same as with the DC voltage application, and more particularly, the capacity increases with decrease of the photosensitive layer thickness, and therefore, the current increases. Therefore, the Ith increases with use of the apparatus.

Figure 7:
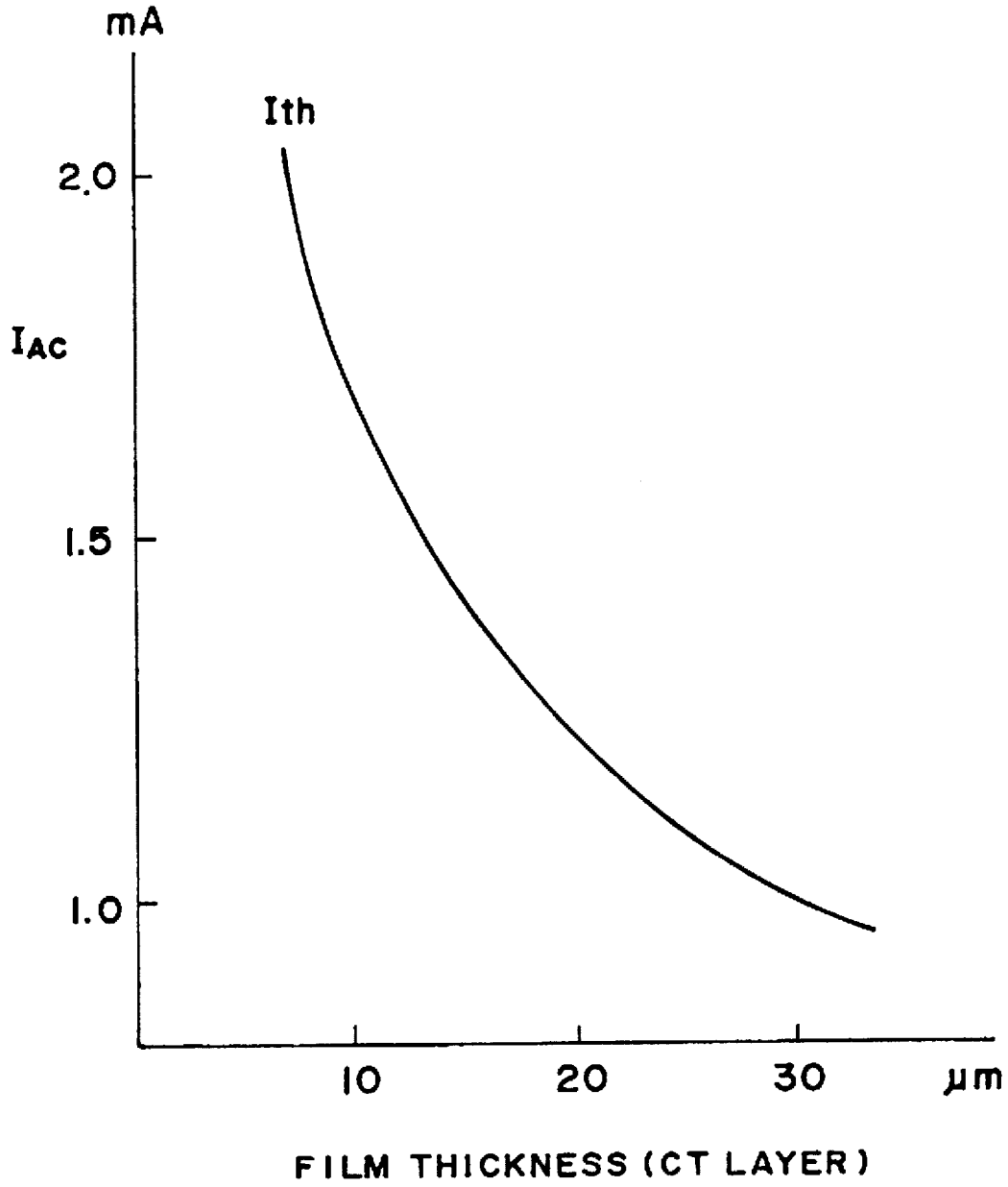
FIG. 7 is a graph showing a relation between a photosensitive layer thickness and an AC current.

FIG. 7 shows an interrelation between the photosensitive layer thickness and Ith. In a conventional AC charging system, constant-current-control for a constant level continues from the initial stage to the last stage, as has been described hereinbefore. Therefore, in FIG. 7, when the photosensitive member having an initial film thickness 30 μm starts to be used with 1.5 mA, it can be used up to approx. 14 μm.

If an averaged scraping speed of the photosensitive member is assumed as being 4μm/10,000 sheets (scraping of 4μm per 10,000 A4 size transfer materials), the service life is 40,000; if the scraping amount is 8μm/10,000 sheets, the life is 20,000. As described hereinbefore, the scraping speed is higher, and therefore, the lifetime of the photosensitive member is shorter, if the current is larger in the AC charging.

In this embodiment, the charging roller 2 is supplied with a predetermined AC voltage and DC voltage for detection in the non-image formation region B1 of FIG. 3.

The difference between the positive component and the negative component of the current at this time, corresponds to the current eventually flowed by the DC component to give the current to the photosensitive member. As described hereinbefore, the DC current amount required for providing the same surface potential changes in accordance with the changing of the film thickness of the photosensitive member.

Figure 8:
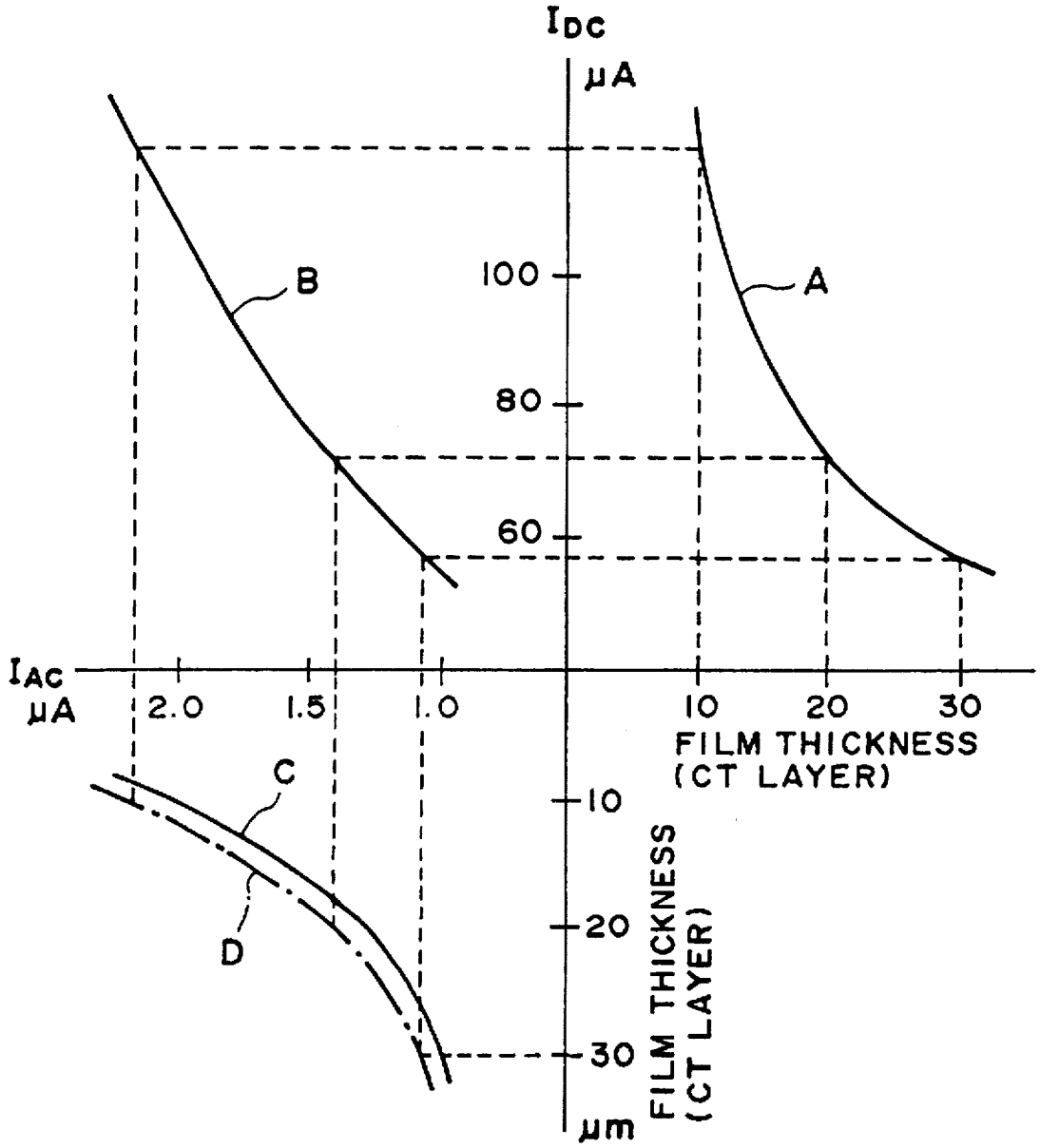
FIG. 8 is a graph showing a relation of an AC current and an average detected current relative to the photosensitive layer thickness.

This is shown in the first quadrant (line A) of the graph in FIG. 8. As will be understood from this graph, the capacity increases, and the DC component $I_{DC}$ flowing to the photosensitive member from the roller 2 increases, in accordance with decrease of the film thickness of the photosensitive member. Therefore, the film thickness can be estimated on the basis of detection of $I_{DC}$. In view of this, the current $I_{DC}$ is detected.

Thereafter, the constant current application in the image formation region is changed in accordance with the current $I_{DC}$, in accordance with the line B in the second quadrant of FIG. 8. The current determined by line B at this time, is slightly larger than Ith for the current photosensitive layer thickness.

The interrelation of the AC constant current determined by the photosensitive layer thickness and line B, is indicated by line D in the third quadrant of FIG. 8. It is deviated to a larger side in the current representing axis than line C indicating the relation between the photosensitive layer thickness and Ith shown in FIG. 7.

Therefore, if the constant current determined by line B is used, the AC charging region is assured for each film thickness of the photosensitive member, and the current is at the level which is slightly higher than Ith by a minimum necessary degree.

Thus, the DC current component flowing from the charging roller to the photosensitive member is detected, and the charging roller is controlled to be a constant current corresponding to the detected level, during the image forming operation. By doing so, the following advantageous effects are provided:

1) Irrespective of the photosensitive layer thickness, the image formation is possible using the AC charging region, and therefore, the uniformity in the charging is assured.

2) AS is different from the conventional completely fixed constant current control, a necessary minimum constant current for each film thickness is given, and therefore, no excessive current is given, thus minimizing the damage to the photosensitive member, and permitting operation with small scraping amount.

Figure 9:
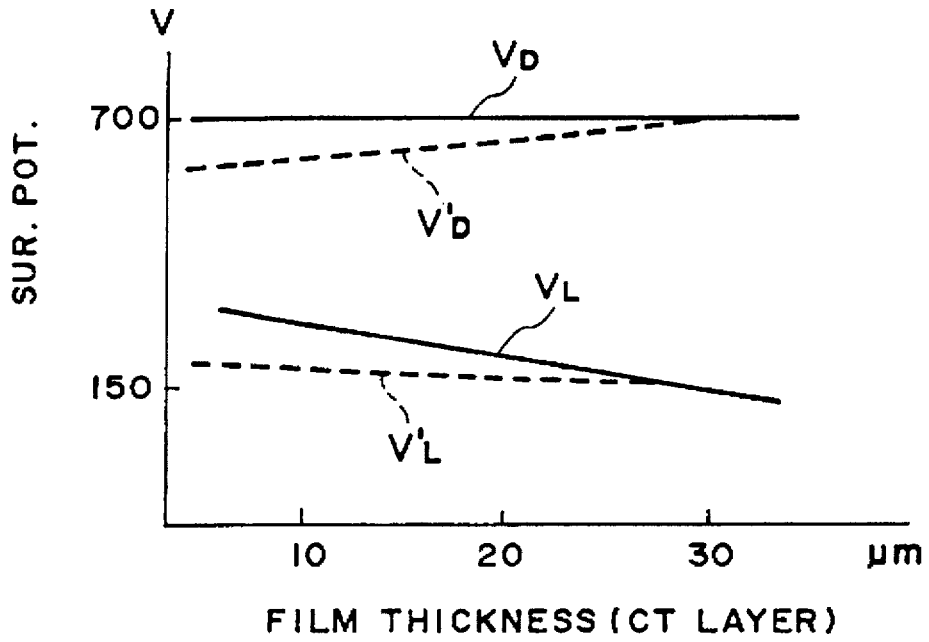
FIG. 9 is a graph showing a relation between a photosensitive layer thickness and a potential of a photosensitive member.
Figure 10:
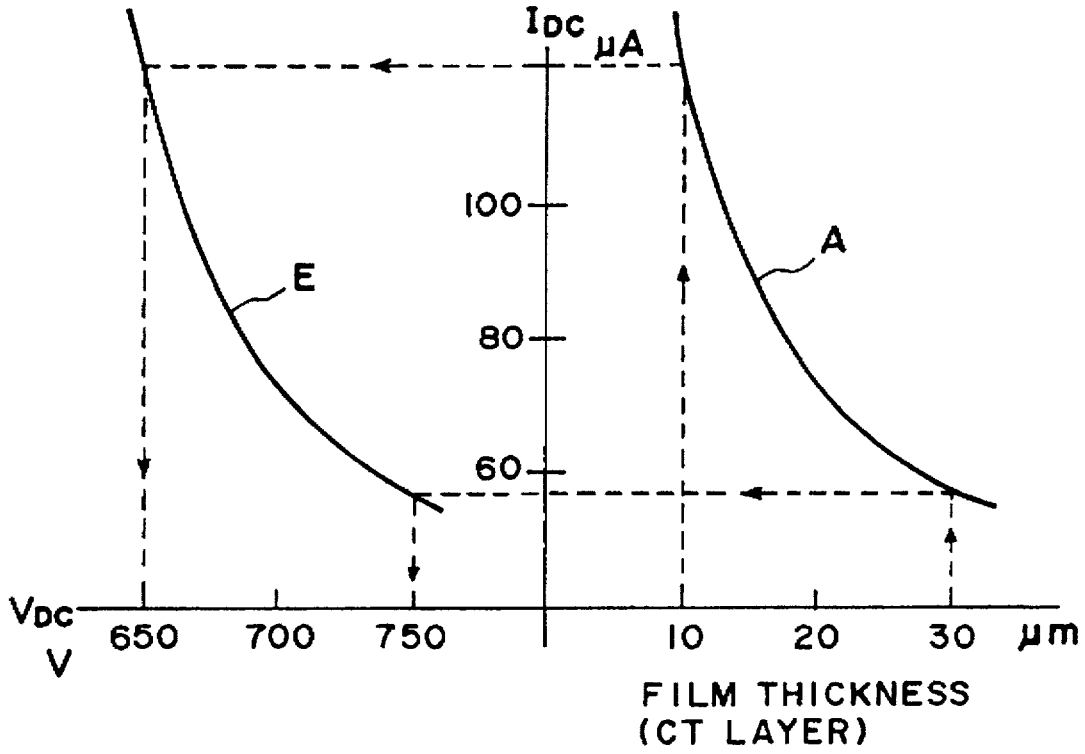
FIG. 10 is a graph showing a relation of an average detected current and a DC voltage relative to a photosensitive layer thickness.

<Embodiment 2> (FIGS. 9 –10)

When the film thickness (CT layer) of the photosensitive member changes, the discharge property from the charging roller changes, as described hereinbefore, and in addition, the apparent photosensitivity of the photosensitive member decreases. More particularly, when the film thickness decreases, the capacity of the photosensitive layer increases, and therefore, if the control provides the surface potential which is the same as in the initial, using the AC charging, the charge density of the photosensitive member surface increases. On the other hand, when the amount of the carrier generated in the photosensitive layer by the same light quantity is substantially the same irrespective of the film thickness, the charge change rate of the photosensitive member surface decreases, with the result that the photosensitivity apparently decreases.

This is showed in FIG. 9. When the photosensitive member dark portion potential $V_D$ is the same, the potential after the exposure indicated by $V_L$ indicated in the Figure increases with decrease of the film thickness. As a result, the contrast relative to the developing bias decreases with the result of production of fog in the image.

In this embodiment, therefore, similarly to embodiment 1, the DC component of the current flowing to the photosensitive member from the charging member during the pre-rotation, is detected, and the AC constant current applied to the charging member during the image formation, is changed, and the DC constant voltage during the image formation is also changed. FIG. 10 shows the control for the DC constant voltage. In this Figure, line A shows an interrelation between the photosensitive layer thickness and the DC current component similarly to (FIG. 8) in embodiment 1, and by detecting the current $I_{DC}$, the film thickness of the photosensitive member is predicted.

In accordance with the average detected current $I_{DC}$, the constant voltage of the DC component applied to the roller at the time of the image formation, is changed (the change in the AC component is the same as with embodiment 1). Line E at this time is such that the $V_{DC}$ decreases with increase of the $I_{DC}$.

As a result, the photosensitive member surface potential at the time of image formation decreases in accordance with increase of $I_{DC}$. Namely, in accordance with decrease of the photosensitive layer thickness, the potential decreases ($V_D'$ in FIG. 9). Since when the surface potential decreases, the potential after the exposure decreases, the film thickness decrease does not result in large potential rise as shown by $V_L'$ in FIG. 9, and the contrast relative to the developing bias is maintained in a proper range, so that the fog is not produced.

Figure 11:
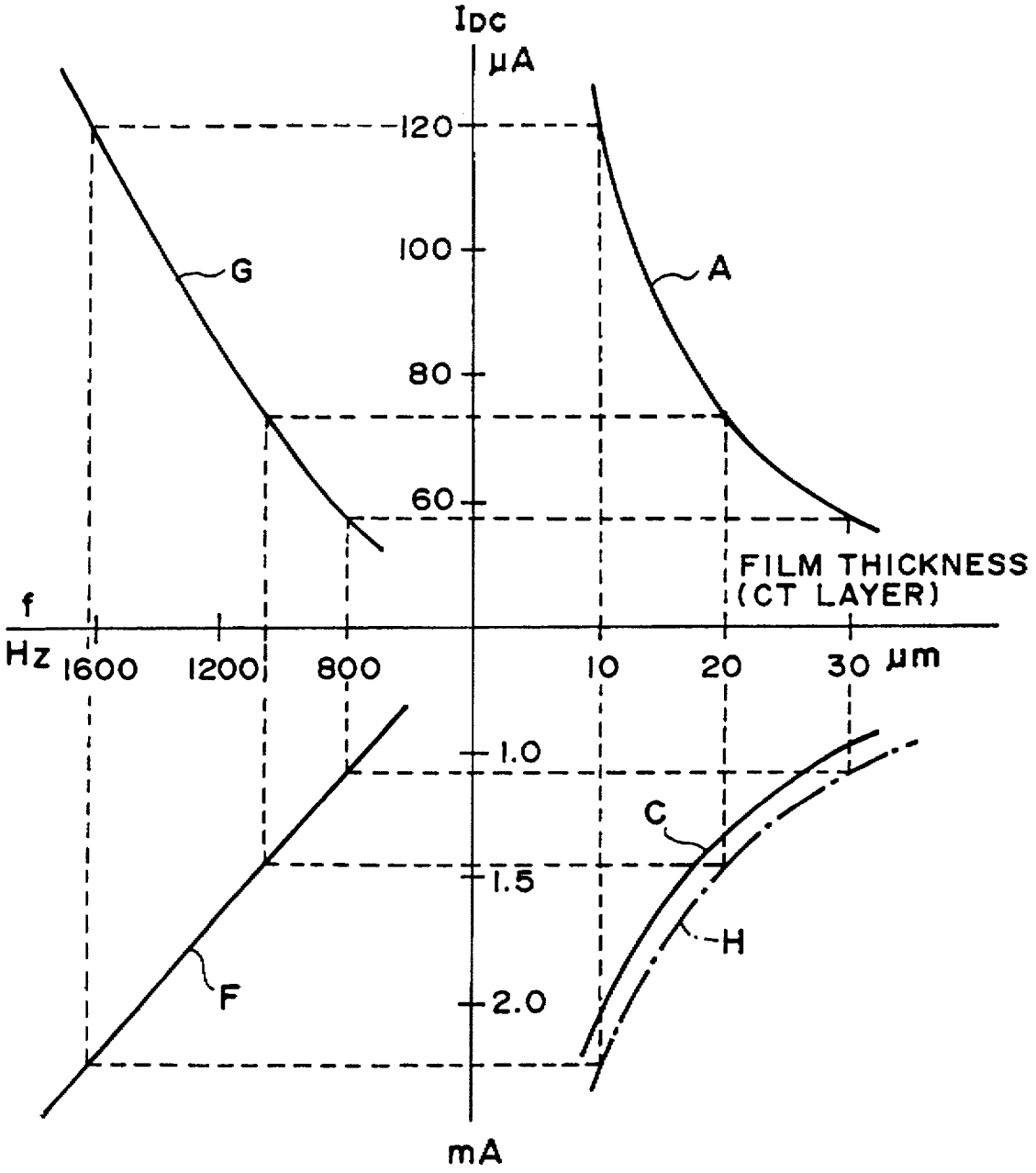
FIG. 11 is a graph showing a relation of an average detected current, an AC frequency and an AC current relative to a photosensitive layer thickness.

<Embodiment 3> (FIG. 11)

Normally, in the AC charging, constant-current-control is carried out, and when the current is to be changed, the applied voltage is changed.

In this example, the frequency which is one of charging conditions in the AC charging, is changed to effect the AC constant current control.

Line F in third quadrant of FIG. 11 shows a relation between the frequency and the AC current. As will be understood from the Figure, the AC current is generally directly proportional to the frequency. The reason is as follows. As described hereinbefore, in the AC charging, the charging and the reverse charging is repeated in the range not less than Vth, and the number of discharging operations repeats with increase of the number of repetitions per unit time, and therefore, the current is proportional to the frequency.

During the pre-rotation, the DC current component flowing through the charging roller 2 (line A corresponding to the film thickness of the photosensitive member 1) is detected. Various detection methods are usable for this detection. For example a DC constant voltage ($V_{DC}$) is superposed on a predetermined AC constant voltage (peak-to-peak voltage $V_{PP}$ and frequency f0), and the superposed voltage is applied, and the DC component of the current by this is detected.

Subsequently, the frequency f1 to be used for the image formation is determined in accordance with the average detected current $I_{DC}$ in accordance with the predetermined interrelation represented by line G in FIG. 11. During the image formation, the AC voltage $V_{PP}$ and the DC constant voltage $V_{DC}$ are fixed, and the frequency is changed to f1, and therefore, the current indicated by line F flows. The AC current $I_{ac}$ flowing at the time of image formation, is as indicated by H in FIG. 11, in connection with the photosensitive layer thickness. Namely, a current flows which is slightly larger than the current Ith at the boundary between the DC charging and the AC charging in the above-described photosensitive layer thicknesses (this is effected by determination of the line G).

AS a result, the image formation is carried out in the AC charging region closely to the minimum necessary degree for each film thickness of the photosensitive member.

This embodiment has the following advantages.

1) Similarly to embodiment 1, smallest possible AC current flows in accordance with each film thickness state of the photosensitive member, so that the scraping amount of the charging roller 2 is minimized.

2) When the photosensitive layer thickness decreases with long term use, the damage on the photosensitive member is remarkable, or the non-uniformity of the film thickness due to the scraping non-uniformity of the photosensitive member tends to appear in the image, and/or the contamination on the surface of the charging roller 2 tends to appear in the image. But, with the increase of the frequency, they can be suppressed. This is because the increase of the frequency increases the number of repetitions of the charging and reverse charging unit time, increases, so that the surface potential of the photosensitive member is made uniform. With this example, the non-uniformity or damage does not tend to appear in the image in long term use.

(Others)

The control method for the image forming apparatus according to the present invention is not limitedly used for an electrophotographic apparatus, but is usable for another type image forming apparatus such as electrostatic recording apparatus using an image bearing member of dielectric member.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

a charging member contactable said image bearing member to charge said image bearing member at a charging position;

wherein an AC current applied to said charging member is constant-current-controlled when a region of said image bearing member which is going to be an image formation region is at said charging position, and wherein a current flowing through said charging member is detected when a region of said image bearing member which is going to be a non-image-formation region is at said charging position, and said AC current is determined on the basis of the detected current.

2. An apparatus according to claim 1, wherein said AC current is determined on the basis of a DC current flowing through said charging member.

3. An apparatus according to claim 1, wherein said charging member is supplied with an AC biased DC voltage.

4. An apparatus according to claim 1, wherein when said current is detected, said charging member is supplied with an AC biased DC voltage.

5. An apparatus according to claim 1, wherein said charging member is provided with a resistance layer contactable the image bearing member and an electroconductive layer provided inside said resistance layer.

* * * * *

UNITED STATES PATENT AND TRADEMARK OFFICE

CERTIFICATE OF CORRECTION

PATENT NO. : 5,717,979

DATED : February 10, 1998

INVENTOR(S) : HISAAKI SENBA, ET AL.

It is certified that error appears in the above-identified patent and that said Letters Patent is hereby corrected as shown below:

COLUMN 2

Line 24, "Mount" should read --amount--.

COLUMN 5

Line 25, "32a" should read --3a--.

COLUMN 8

Line 42, "AS" should read --As--.

COLUMN 9

Line 37, "constant current control."
should read --constant-current control.--; and
Line 38, "in" should read --in the--.

COLUMN 10

Line 5, "AS" should read --As--; and
Line 8, "advantages." should read --advantages:--.

UNITED STATES PATENT AND TRADEMARK OFFICE

CERTIFICATE OF CORRECTION

PATENT NO. : 5,717,979

DATED : February 10, 1998

INVENTOR(S) : HISAAKI SENBA, ET AL.

It is certified that error appears in the above-identified patent and that said Letters Patent is hereby corrected as shown below:

COLUMN 10

Line 42, "position;" should read --position; and--.

Signed and Sealed this

Thirteenth Day of October 1998

Bruce Lehman

*Attest:*

BRUCE LEHMAN

*Attesting Officer*

*Commissioner of Patents and Trademarks*